US012303733B2

(12) United States Patent
Zhang

(10) Patent No.: US 12,303,733 B2
(45) Date of Patent: May 20, 2025

(54) BUCKLE FOR DUMBBELLS AND BARBELLS

(71) Applicant: Yiheng Zhang, Guangdong (CN)

(72) Inventor: Yiheng Zhang, Guangdong (CN)

( * ) Notice: Subject to any disclaimer, the term of this patent is extended or adjusted under 35 U.S.C. 154(b) by 223 days.

(21) Appl. No.: 18/328,294

(22) Filed: Jun. 2, 2023

(65) Prior Publication Data

US 2024/0382795 A1 Nov. 21, 2024

(30) Foreign Application Priority Data

May 19, 2023 (CN) ..... 202321231750.0

(51) Int. Cl.
*A63B 21/072* (2006.01)

(52) U.S. Cl.
CPC ..... *A63B 21/0728* (2013.01)

(58) Field of Classification Search
CPC ..... A63B 21/0726; A63B 21/0728; A63B 2244/09; Y10T 24/1412; Y10T 24/1424; Y10T 24/1418; Y10T 24/142; F16B 2/18; F16B 2/185
See application file for complete search history.

(56) References Cited

U.S. PATENT DOCUMENTS 5,344,375 A * 9/1994 Cooper ..... A63B 21/0728 482/106
6,887,189 B2 5/2005 Schiff
9,011,300 B2 4/2015 Hodes
9,138,610 B2 * 9/2015 Lovegrove ..... A63B 21/0004
9,841,040 B2 * 12/2017 Burnett ..... B25B 5/12
10,953,263 B2 3/2021 Stilson
D943,040 S * 2/2022 Nyquist ..... D21/694
11,359,653 B2 * 6/2022 Huang ..... B25B 5/147
D1,060,550 S * 2/2025 Zhang ..... D21/694
2004/0163723 A1 * 8/2004 Taylor ..... F16L 1/26 285/15
2010/0132165 A1 * 6/2010 Shor ..... F16L 37/1225 24/19
2013/0184129 A1 * 7/2013 Lovegrove ..... A63B 21/0728 482/107
2016/0030796 A1 * 2/2016 Lovegrove ..... A63B 23/12 482/93
2016/0333908 A1 * 11/2016 Burnett ..... F16B 2/185
2018/0066684 A1 * 3/2018 Burnett ..... F16B 2/005
2018/0326251 A1 11/2018 Stilson
(Continued)

*Primary Examiner* — Gary D Urbiel Goldner

(57) ABSTRACT

A buckle for dumbbells and barbells includes a clamping head, two locking keys symmetrically mounted on the clamping head, and two operation bars symmetrically mounted on the clamping head and hinged to the locking keys. The clamping head is a C-shaped structure having an opening at one end thereof. An accommodating groove and two mounting holes in communication with each other are formed in the clamping head. The accommodating groove is located on an outer side of the clamping head away from the opening and is configured to accommodate the two operation bars. The two mounting holes are located on an inner side of the clamping head close to the opening and are configured to respectively accommodate the two locking keys. The buckle is convenient to mount and dismount, easy to operate during usage, and enables symmetrically applied clamping forces with high clamping stability and a good effect.

10 Claims, 6 Drawing Sheets

(56) References Cited

U.S. PATENT DOCUMENTS

| | | | |
|---|---|---|---|
| 2021/0205653 | A1 | 7/2021 | Stilson |
| 2022/0143453 | A1 | 5/2022 | Martin |
| 2022/0314060 | A1 | 10/2022 | Wittenbrink |
| 2022/0331643 | A1 | 10/2022 | Kehlenbach et al. |

* cited by examiner

BUCKLE FOR DUMBBELLS AND BARBELLS

TECHNICAL FIELD

The present invention relates to the technical field of sports equipment, in particular to a buckle for dumbbells and barbells.

BACKGROUND

A buckle for barbell and dumbbell bars is a locking structure used at the end of an Olympic bar to fix a counterweight, and has the effects of fixing the counterweight, protecting a weightlifting action and avoiding loosening and flying of the counterweight from the Olympic bar due to the excessively large movement amplitude during usage. However, an existing buckle is of a ring structure formed by two lockable semicircular lock catches, and the ring buckle needs to be arranged on the outer side of the Olympic bar in a penetrating manner along the end of the Olympic bar when the buckle is mounted onto and dismounted from the Olympic bar, so that the buckle is tedious to operate and inconvenient to use.

SUMMARY

On this basis, in order to solve the problems of the existing buckle for dumbbells and barbells, it is necessary to provide a buckle for dumbbells and barbells, which is convenient to mount and dismount and easy to operate.

The buckle for dumbbells and barbells comprises: a clamping head, two locking keys symmetrically mounted on the clamping head, and two operation bars symmetrically mounted on the clamping head and hinged to the locking keys, wherein the clamping head is of a C-shaped structure having an opening at one end thereof, an accommodating groove and two mounting holes which are in communication with each other are formed in the clamping head, the accommodating groove is located on the outer side of the clamping head away from the opening and is configured to accommodate the operation bars, and the mounting holes are located on the inner side of the clamping head close to the opening and are configured to accommodate the locking keys; first fixing pins are mounted on the locking keys, and the first fixing pins are hinged to the clamping head; and second fixing pins are mounted on the operation bars, the second fixing pins are hinged to the clamping head, and the ends of the operation bars close to the mounting holes are hinged to the ends of the locking keys away from the mounting holes.

With regard to the buckle, during usage, the locking keys are driven by hand through the operation bars to swing to retreat into the mounting holes, then the clamping head clamps one side of an end of an Olympic bar by means of the opening to abut against the end of the Olympic bar, and finally, the locking keys are driven by hand through the operation bars to extend out of the mounting holes to clamp the Olympic bar clamped in the clamping head, thereby realizing the locking process of mounting the buckle on the Olympic bar. The buckle is convenient to mount and dismount and easy to operate during usage. In addition, the two locking keys and the two operation bars are symmetrically mounted on the clamping head, so that the applied clamping forces are symmetric, the clamping stability is high, and the effect is good.

In one of the embodiments, the buckle further comprises connecting members, wherein one end of each of the connecting members is hinged to the end of the corresponding operation bar close to the corresponding mounting hole, and the other end of the connecting member is hinged to the end of the corresponding locking key away from the corresponding mounting hole.

In one of the embodiments, the buckle further comprises tension springs, wherein one end of each of the tension springs is connected to the side of the top of the corresponding locking key away from the corresponding operation bar, and the other end of the tension spring is connected to the clamping head.

In one of the embodiments, traction blocks are arranged on the sides of the tops of the locking keys away from the operation bars, mounting pins are arranged in the clamping head, and both ends of the tension springs are connected to the traction blocks and the mounting pins respectively.

In one of the embodiments, arc-shaped clamping surfaces are provided on the bottom sides of the locking keys, and the arc-shaped clamping surfaces match with an arc-shaped surface of the inner side of the clamping head.

In one of the embodiments, handle portions are arranged on the operation bars, and the handle portions are located at the ends of the operation bars away from the mounting holes.

In one of the embodiments, an avoiding gap is formed in the clamping head, and the avoiding gap is located in the middle of the outer side of the clamping head.

In one of the embodiments, a plurality of anti-collision blocks are further arranged on the clamping head, and the anti-collision blocks are located on an inner wall of the accommodating groove close to the opening.

In one of the embodiments, the buckle further comprises a jacket mounted on the clamping head.

In one of the embodiments, the buckle further comprises a magnetic attraction block mounted between the jacket and the clamping head.

BRIEF DESCRIPTION OF THE DRAWINGS

Drawings constituting a portion of the present application are used for providing a further understanding to the present invention; and schematic embodiments of the present invention and descriptions thereof are intended to explain the present invention, and should not be construed to unduly limit this invention. In the drawings.

DETAILED DESCRIPTION OF THE EMBODIMENTS

Figure 1:
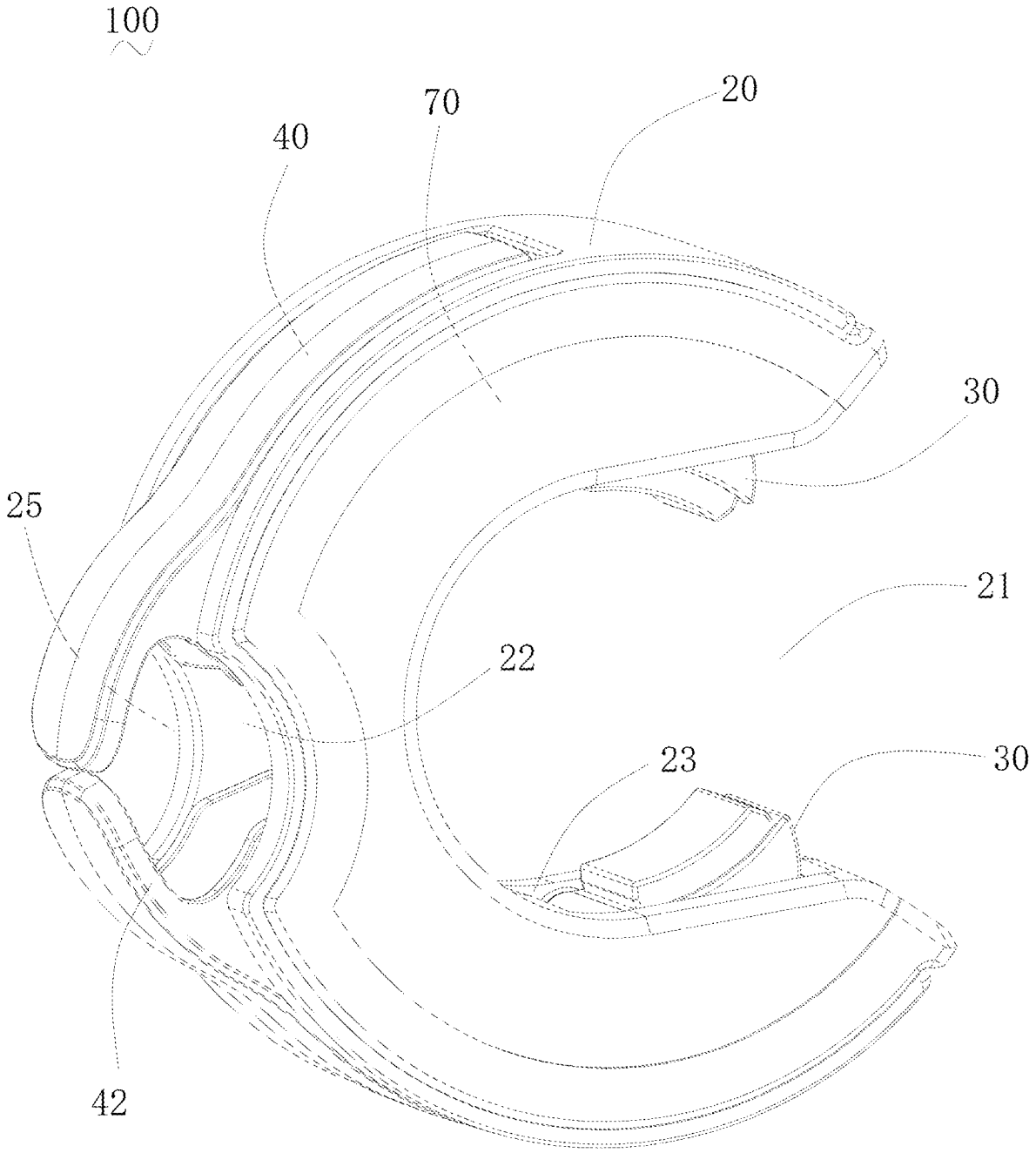
FIG. 1 is a schematic diagram of a buckle for dumbbells and barbells of the present invention.

To facilitate understanding of the present invention, the present invention will be described more comprehensively below with reference to related drawings. Preferred embodiments of the present invention are provided in the drawings.

However, the present invention may be achieved in various forms, and is not limited to the embodiments herein. On the contrary, these embodiments are provided for a more thorough and comprehensive understanding of the content disclosed in the present invention.

It should be noted that when an element is expressed as "fixed to" another element, it may be directly located on another element, or there may be an intermediate element. When an element is expressed as "connected to" another element, it may be directly connected to another element, or there may be an intermediate element at the same time. In addition, the term "and/or" herein is only intended to describe association relationships of related objects, and indicates that there may be three relationships, for example, the expression of "A and/or B" may indicate the following three conditions: A exists separately, A and B exist at the same time, and B exists separately.

Unless otherwise defined, all technical and scientific terms used herein have the same meanings as those generally understood by those skilled in the art of the present invention. The terms used in the description of the present invention herein are only for the purpose of describing particular embodiments, for example, "inner", "outer", "left", "right" and similar expressions are only for the purpose of illustration, and are not intended to limit the present invention.

Figure 2:
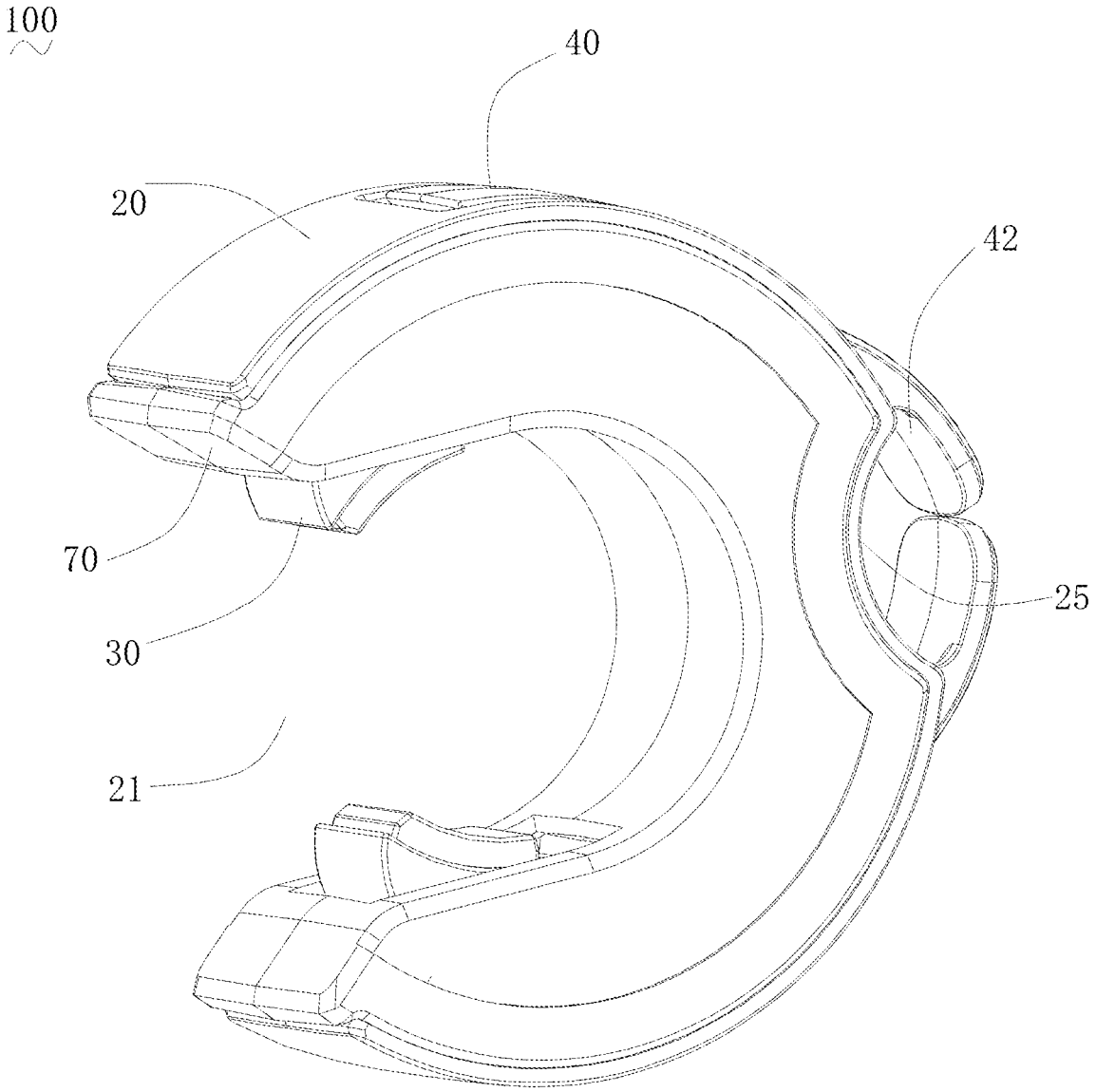
FIG. 2 is another schematic diagram of the buckle for dumbbells and barbells as shown in FIG. 1.
Figure 3:
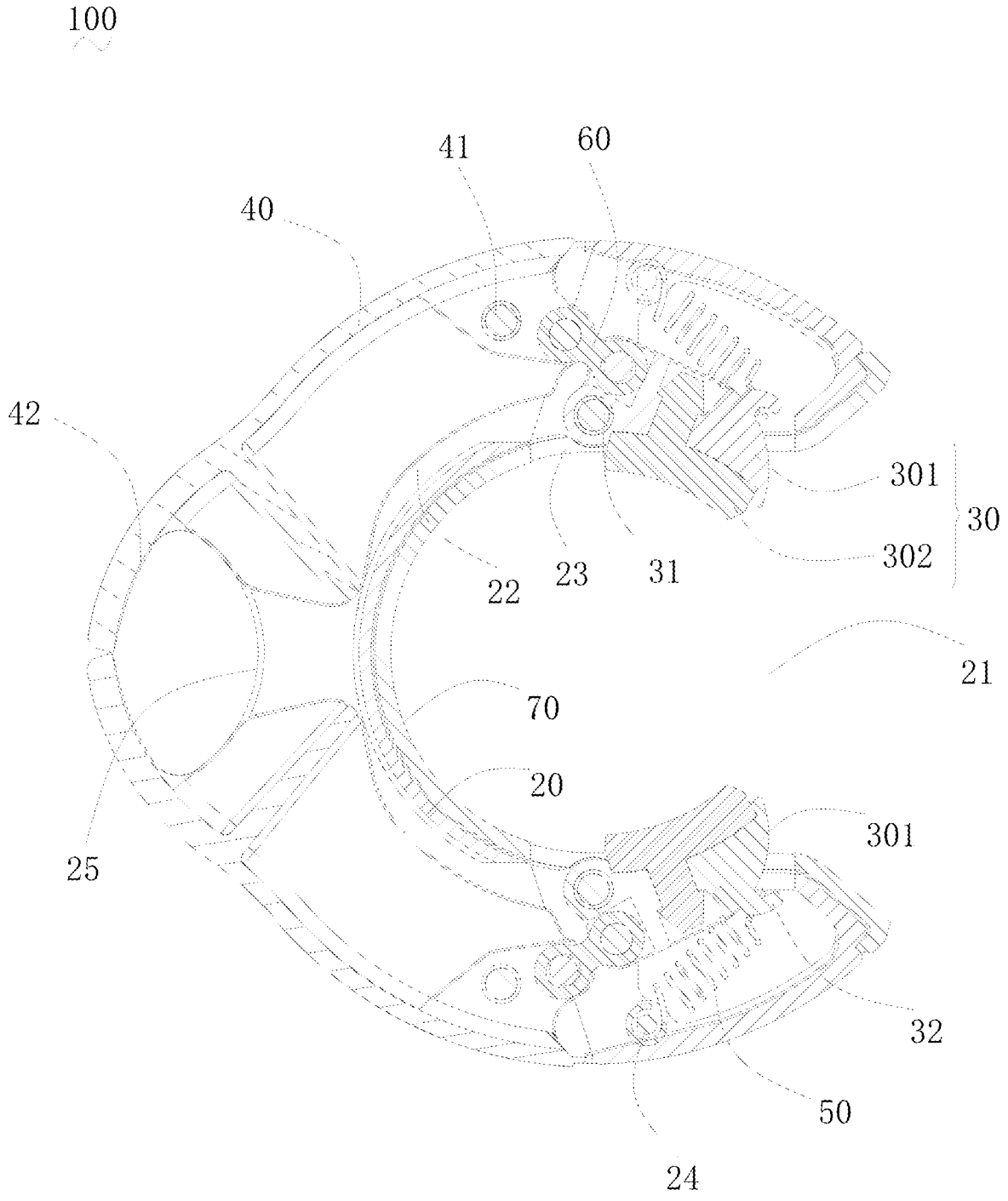
FIG. 3 is a sectional view of the buckle for dumbbells and barbells as shown in FIG. 1.
Figure 4:
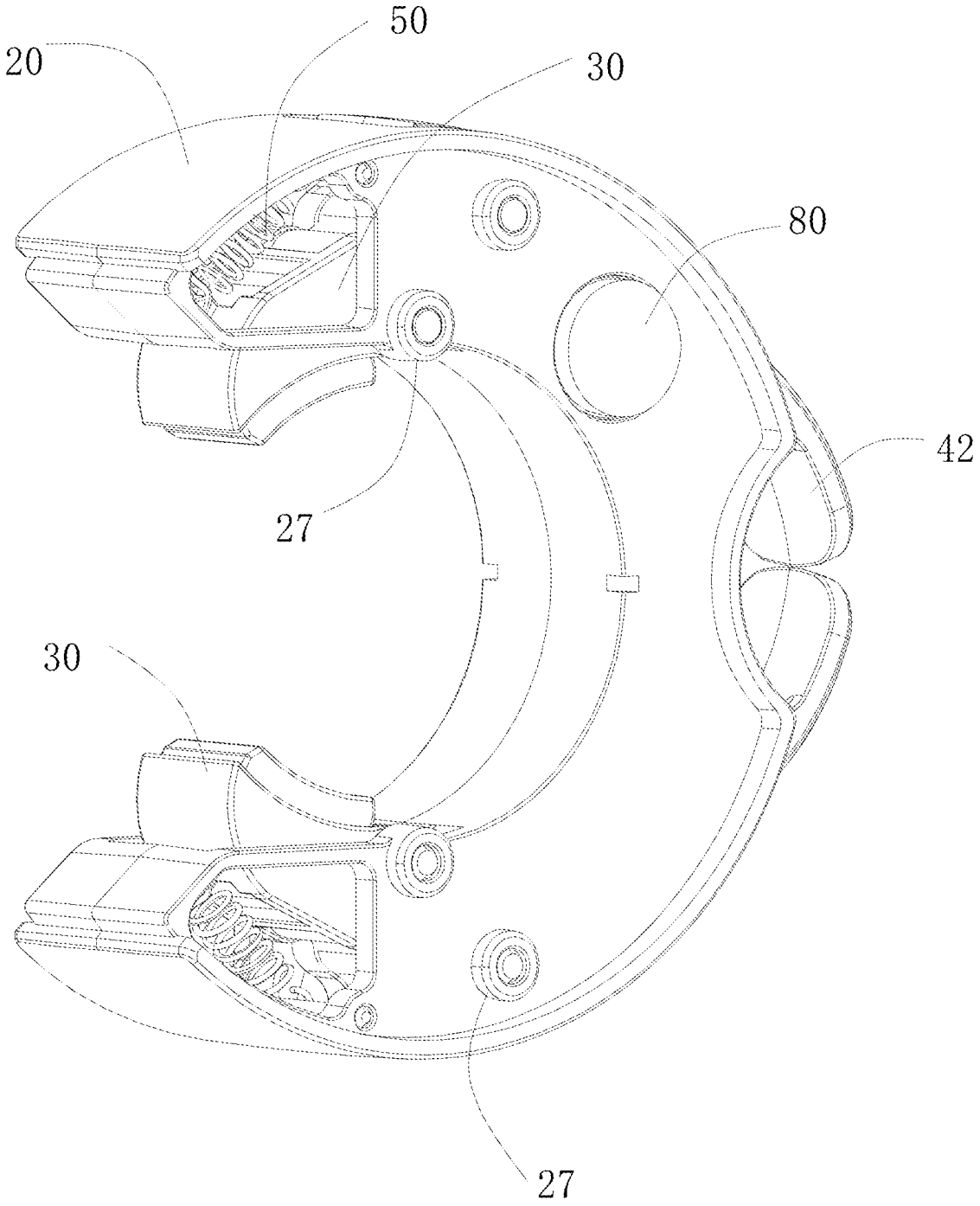
FIG. 4 is a local view of the buckle for dumbbells and barbells as shown in FIG. 1.
Figure 5:
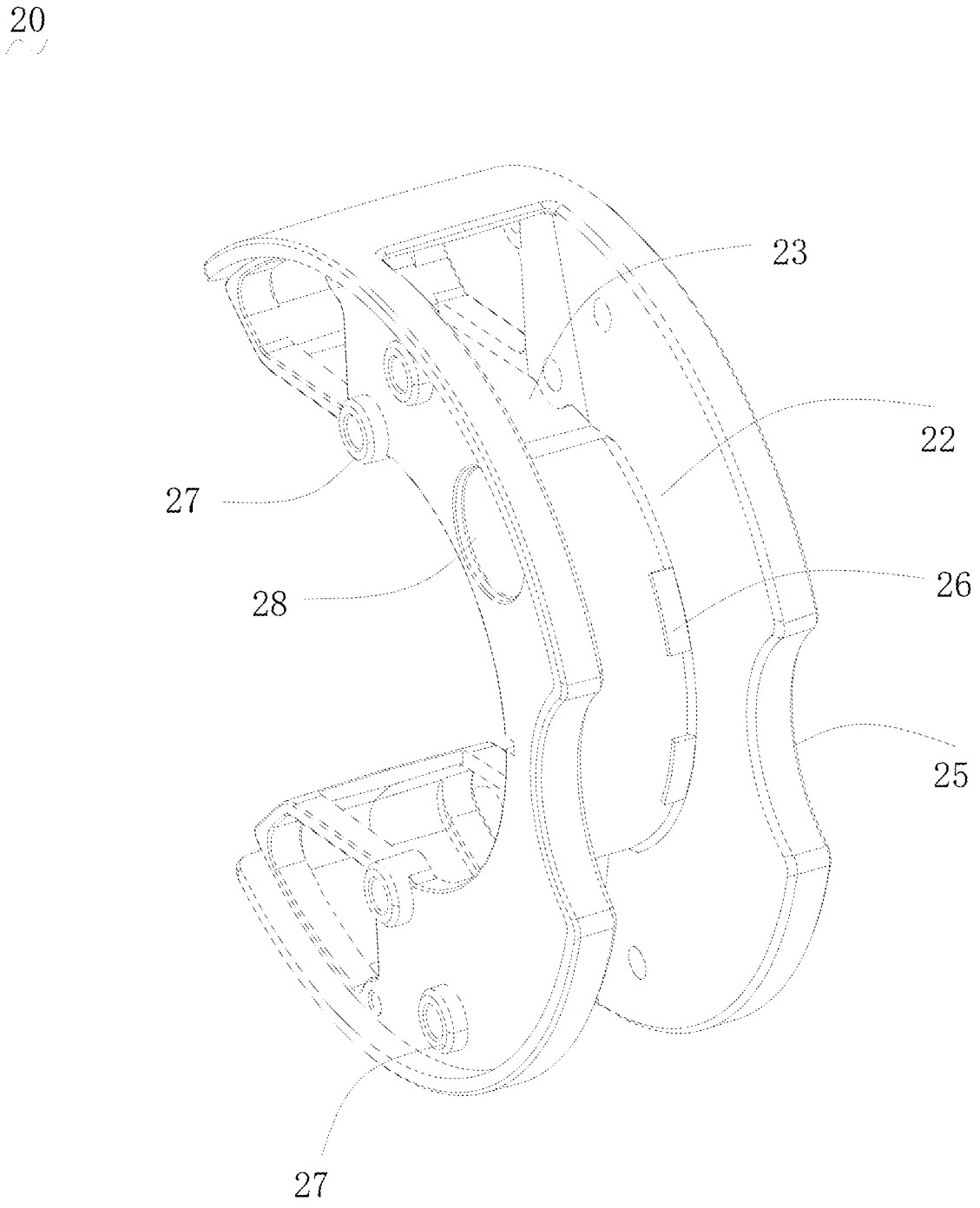
FIG. 5 is a schematic diagram of a clamping head of the buckle for dumbbells and barbells as shown in FIG. 1.
Figure 6:
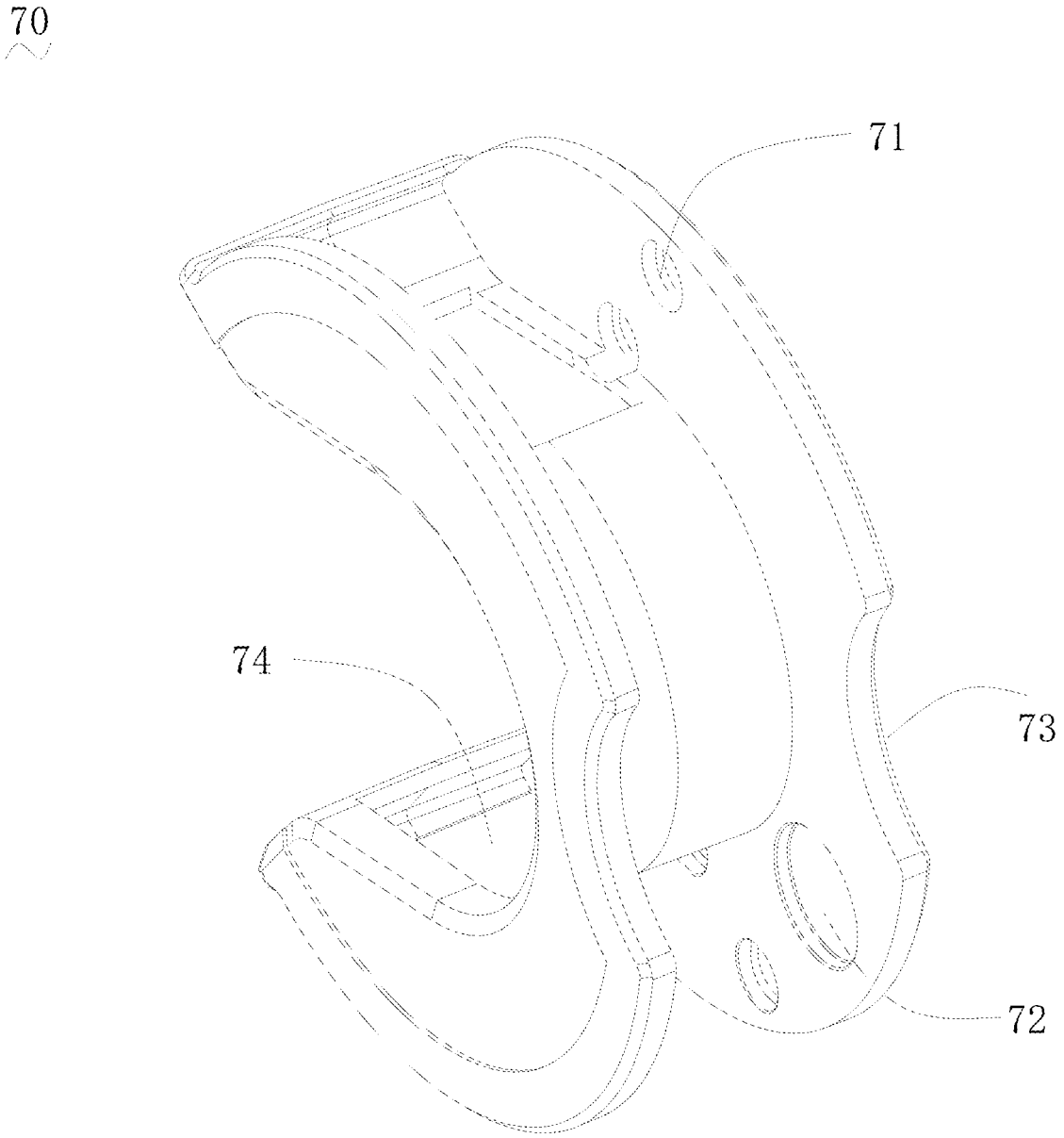
FIG. 6 is a schematic diagram of a jacket of the buckle for dumbbells and barbells as shown in FIG. 1.

Reference is made to FIGS. 1-6 which are schematic diagrams of a buckle 100 for dumbbells and barbells of the present invention. The buckle 100 is mounted at an end of an Olympic bar of a dumbbell or a barbell during usage to fix a counterweight. The buckle 100 comprises a clamping head 20, two locking keys 30 symmetrically mounted on the clamping head 20, and two operation bars 40 symmetrically mounted on the clamping head 20 and hinged to the locking keys 30, wherein one operation bar 40 is hinged to one locking key 30, and the operation bar 40 can drive the locking key 30 to swing.

Further, the clamping head 20 is of a C-shaped structure having an opening 21 at one end thereof, an accommodating groove 22 and two mounting holes 23 which are in communication with each other are formed in the clamping head 20, the accommodating groove 22 is located on the outer side of the clamping head 20 away from the opening 21 and is configured to accommodate the operation bars 40, and the mounting holes 23 are located on the inner side of the clamping head 20 close to the opening 21 and are configured to accommodate the locking keys 30. First fixing pins 31 are mounted on the locking keys 30, and the first fixing pins 31 are hinged to the clamping head 20, so that the locking keys 30 can rotate on the clamping head 20 by means of the first fixing pins 31. Second fixing pins 41 are mounted on the operation bars 40, the second fixing pins 41 are hinged to the clamping head 20, and the ends of the operation bars 40 close to the mounting holes 23 are hinged to the ends of the locking keys 30 away from the mounting holes 23, so that the operation bars 40 can swing to drive the locking keys 30 to swing, thereby realizing direct switching between a locking state and an unlocking state. The clamping head 20 is made of an aluminum alloy material, which enhances the strength of the clamping head 20. In addition, outer surfaces of the locking keys 30 are made of rubber materials, thereby increasing the friction force of the positions where the locking keys 30 make contact with the Olympic bar, and ensuring that the locking keys 30 at the front end of the buckle 100 can better lock the Olympic bar. In this embodiment, the opening 21 is a horn mouth, so that the buckle 100 can clamp the side of one end of the Olympic bar conveniently to abut against the end of the Olympic bar.

Further, in this embodiment, each of the locking keys 30 comprises a key base 301 and a clamping block 302 detachably mounted on the key base 301, the clamping block 302 is made of a rubber material, thereby increasing the friction force of the position where the locking key 30 makes contact with the Olympic bar, and ensuring that the locking key 30 at the front end of the buckle 100 can better lock the Olympic bar. In addition, the clamping blocks 302 may be replaced according to usage conditions, and are very practical and convenient.

Further, the buckle 100 further comprises tension springs 50, wherein one end of each of the tension springs 50 is connected to the side of the top of the corresponding locking key 30 away from the corresponding operation bar 40, and the other end of the tension spring 50 is connected to the clamping head 20. When an operator pulls upwards the operation bars 40, the ends of the operation bars 40 move to drive the ends of the locking keys 30 to rotate, at this moment, the tension springs 50 are used for pulling the locking keys 30 to assist the locking keys 30 in rotating upwards to reach the positions inside the mounting holes 23, and thus the buckle can be conveniently mounted onto or dismounted from the Olympic bar as a whole. Further, traction blocks 32 are arranged on the sides of the tops of the locking keys 30 away from the operation bars 40, mounting pins 24 are arranged in the clamping head 20, and both ends of the tension springs 50 are connected to the traction blocks 32 and the mounting pins 24 respectively. Specifically, the mounting pins 24 are located at obliquely upper side of the tops of the locking keys 30 close to the operation bars 40.

Further, arc-shaped clamping surfaces 33 are provided on the bottom sides of the locking keys 30, and the arc-shaped clamping surfaces 33 match with an arc-shaped surface of the inner side of the clamping head 20. In some embodiments, a plurality of groups of magnets (not shown) distributed in a lengthwise direction of the accommodating groove 22 are arranged on the side of the inside of the clamping head 20 away from the accommodating groove 22, and outer surfaces of the magnets are parallel with the arc-shaped surface of the inner side of the clamping head 20. In this way, secondary locking is performed on the Olympic bar by means of the magnets cooperating with the locking keys 30, so as to improve the Olympic bar locking stability of the entire buckle.

Further, the buckle 100 further comprises connecting members 60, wherein one end of each of the connecting members 60 is hinged to the end of the corresponding operation bar 40 close to the corresponding mounting hole 23, and the other end of the connecting member 60 is hinged to the end of the corresponding locking key 30 away from the corresponding mounting hole 23. In other embodiments, the connecting members 60 may be replaced with hinge pins, and all that is needed is to make the hinge pins penetrate through the operation bars 40 and the locking keys 30 at the same time.

Further, handle portions 42 are arranged on the operation bars 40, and the handle portions 42 are located at the ends of the operation bars 40 away from the mounting holes 23, so that fingers of the operator can conveniently extend into the handle portions 42 to pull the operation bars 40 to rotate upwards, and the convenience in operation is improved. Further, an avoiding gap 25 is formed in the clamping head 20, and the avoiding gap 25 is located in the middle of the outer side of the clamping head 20, so that the fingers of the operator can extend into the handle portions 42 more conveniently.

Further, a plurality of anti-collision blocks 26 are further arranged on the clamping head 20, and the anti-collision blocks 26 are located on an inner wall of the accommodating groove 22 close to the opening 21, so that when the operation bars 40 are pulled to enter the accommodating groove 22, the operation bars 40 are supported and blocked, and collisions and abrasions of the clamping head 20 are reduced.

In another embodiment, the buckle 100 further comprises a jacket 70 mounted on the clamping head 20, and the jacket 70 protects the clamping head 20, so that the clamping head 20 is prevented from being easily damaged, and then the service life is prolonged. A plurality of mounting columns 27 are arranged on an outer wall of the clamping head 20, a plurality of mounting grooves 71 are formed in an inner wall of the jacket 70, and the mounting grooves 71 match with the mounting columns 27 in a one-to-one correspondence manner, so that the jacket 70 can be mounted on the clamping head 20 by means of assembling of the mounting grooves 71 and the mounting columns 27.

In another embodiment, the buckle 100 further comprises a magnetic attraction block 80 mounted between the jacket 70 and the clamping head 20. The magnetic attraction block 80 can generate a magnetic attraction force, so that the buckle 100 can be attracted to a barbell stand after usage, and the buckle is convenient to store and place and is very practical.

Further, a first groove 28 is formed in the outer wall of the clamping head 20, a second groove 72 is formed in the inner wall of the jacket 70, and the magnetic attraction block 80 is mounted in a space formed by the first groove 28 and the second groove 72. The jacket 70 in this embodiment is composed of two symmetric portions, so that the jacket 70 can be conveniently mounted onto and dismounted from the clamping head 20. Further, a concave opening 73 and a rectangular opening 74 are formed in the jacket 70, the concave opening 73 matches with the avoiding gap 25, and the rectangular opening 74 is opposite to and in communication with the mounting holes 23.

With regard to the buckle 100, during usage, the locking keys 30 are driven by hand through the operation bars 40 to swing to retreat into the mounting holes 23, then the clamping head 20 clamps the side of the end of the Olympic bar by means of the opening 21 to abut against the end of the Olympic bar, and finally, the locking keys are driven by hand through the operation bars 40 to extend out of the mounting holes to clamp the Olympic bar clamped in the clamping head 20, thereby realizing the locking process of mounting the buckle on the Olympic bar. The buckle 100 is convenient to mount and dismount and easy to operate during usage. In addition, the two locking keys 30 and the two operation bars 40 are symmetrically mounted on the clamping head 20, so that the applied clamping forces are symmetric, the clamping stability is high, and the effect is good.

The technical features of the above embodiments can be combined arbitrarily. In order to simplify the description, possible combinations of the technical features of the above embodiments are not completely described. However, as long as there is no contradiction between the combinations of these technical features, the combinations should be considered to fall within the scope of the present specification.

The above embodiments only express several embodiments of the present invention, and relative specific and detailed descriptions thereof are provided. However, these embodiments cannot be understood as limitations on the scope of the patent of the present invention. It should be pointed out that for those of ordinary skill in the art, several modifications and improvements can be made without departing from the idea of the present invention, and all these modifications and improvements should fall within the scope of protection of the present invention. Therefore, the scope of protection of the patent of the present invention should be subject to the claims.

What is claimed is:

1. A buckle for dumbbells and barbells, the buckle comprising:

a clamping head;

two locking keys symmetrically mounted on the clamping head; and two operation bars symmetrically mounted on the clamping head and respectively hinged to the two locking keys;

wherein the clamping head is a C-shaped structure having an opening at one end thereof;

wherein an accommodating groove and two mounting holes in communication with each other are formed in the clamping head, the accommodating groove is located on an outer side of the clamping head away from the opening and is configured to accommodate the two operation bars, and the two mounting holes are located on an inner side of the clamping head close to the opening and are configured to respectively accommodate the two locking keys;

wherein first fixing pins are respectively mounted on the two locking keys, and the first fixing pins are hinged to the clamping head;

wherein second fixing pins are respectively mounted on the two operation bars, the second fixing pins are hinged to the clamping head; and wherein ends of the two operation bars close to the two mounting holes are hinged to ends of the two locking keys away from the two mounting holes, respectively.

2. The buckle according to claim 1, further comprising connecting members, wherein one end of each of the connecting members is hinged to the end of the corresponding operation bar close to the corresponding mounting hole, and another end of each of the connecting members is hinged to the end of the corresponding locking key away from the corresponding mounting hole.

3. The buckle according to claim 1, further comprising tension springs, wherein one end of each of the tension springs is connected to a side of a top of the corresponding locking key away from the corresponding operation bar, and another end of each of the tension springs is connected to the clamping head.

4. The buckle according to claim 3, wherein traction blocks are respectively arranged on the sides of the tops of the locking keys away from the operation bars, mounting pins are arranged in the clamping head, and both ends of the tension springs are connected to the traction blocks and the mounting pins, respectively.

5. The buckle according to claim 1, wherein arc-shaped clamping surfaces are respectively provided on bottom sides of the two locking keys, and the arc-shaped clamping surfaces match with an arc-shaped surface of the inner side of the clamping head.

6. The buckle according to claim 1, wherein handle portions are respectively arranged on the two operation bars, and the handle portions are respectively located at the ends of the two operation bars away from the two mounting holes.

7. The buckle according to claim 6, wherein an avoiding gap is formed in the clamping head, and the avoiding gap is located in a middle of the outer side of the clamping head.

8. The buckle according to claim 1, wherein a plurality of anti-collision blocks are further arranged on the clamping head, and the plurality of anti-collision blocks are located on an inner wall of the accommodating groove close to the opening.

9. The buckle according to claim 1, further comprising a jacket mounted on the clamping head.

10. The buckle according to claim 9, further comprising a magnetic attraction block mounted between the jacket and the clamping head.

* * * * *